US012408771B1

(12) United States Patent
Kerr

(10) Patent No.: US 12,408,771 B1
(45) Date of Patent: Sep. 9, 2025

(54) CADDY

(71) Applicant: Paris Kerr, Melbourne (AU)

(72) Inventor: Paris Kerr, Melbourne (AU)

(73) Assignee: DOT DESIGN GROUP PTY LTD, Melbourne (AU)

( * ) Notice: Subject to any disclaimer, the term of this patent is extended or adjusted under 35 U.S.C. 154(b) by 0 days.

(21) Appl. No.: 18/640,057

(22) Filed: Apr. 19, 2024

(51) Int. Cl.

| | |
|---|---|
| ***A47F 7/28*** | (2006.01) |
| ***A47B 73/00*** | (2006.01) |
| ***A47F 7/00*** | (2006.01) |
| *A47F 5/08* | (2006.01) |

(52) U.S. Cl.
CPC ..... *A47F 7/283* (2013.01); *A47B 73/00* (2013.01); *A47F 7/0028* (2013.01); *A47F 5/08* (2013.01); *A47F 7/28* (2013.01)

(58) Field of Classification Search
CPC ..... A47F 7/283; A47F 7/28; A47F 7/0028; A47F 7/0021; A47F 7/00; A47F 5/08; A47F 5/00; A47B 73/00; A47B 81/00; A47B 81/007
See application file for complete search history.

(56) References Cited

U.S. PATENT DOCUMENTS 1,389,984 A * 9/1921 Reed ..... A47J 47/16 211/74
1,615,571 A * 1/1927 Crecelius ..... A47K 1/09 206/229
1,663,822 A * 3/1928 Walker ..... B67B 7/18 211/74
2,190,567 A * 2/1940 Jung ..... A47F 7/283 248/108
2,305,965 A * 12/1942 Henkel ..... A47G 23/02 211/75
D156,729 S * 1/1950 Hampe ..... D6/569
D164,562 S * 9/1951 Feinberg ..... D6/563
3,224,644 A * 12/1965 Davis ..... B65D 83/267 222/162
3,349,922 A * 10/1967 Morrison ..... A47G 25/746 211/113
D252,429 S * 7/1979 Morin ..... D6/569
4,182,455 A * 1/1980 Zurawin ..... B65D 71/70 211/69.8
4,637,580 A * 1/1987 Idstein ..... A47J 47/16 248/220.21
D294,442 S * 3/1988 Bordian ..... D6/528
4,848,714 A * 7/1989 Ziaylek, Jr. ..... A62C 13/78 248/313
4,871,074 A * 10/1989 Bryson ..... A45D 20/12 211/70.6
D307,373 S * 4/1990 Bearak ..... D7/701
(Continued)

*Primary Examiner* — Devin K Barnett
(74) *Attorney, Agent, or Firm* — Braxton Perrone, PLLC; Bobby W. Braxton; Gregory Perrone

(57) ABSTRACT

A caddy for holding one or a plurality of containers is disclosed. The caddy has a flexible top brace. The flexible top brace has a plurality of top contours along its length. There is a frame coupled to the flexible top brace. The frame is further coupled to a plurality of bottom contours which are located below each top contour. The bottom contour has a raised portion. The top brace and the bottom contours act together to grasp the can. This allows the can, and all of the marketing material, to be presented to the consumer with an unobstructed view.

15 Claims, 10 Drawing Sheets

(56) References Cited

U.S. PATENT DOCUMENTS 4,984,693 A * 1/1991 Belokin, Jr. ..... A47F 5/0876 D6/567
D320,536 S * 10/1991 Silbernagel ..... D7/619.1
D323,766 S * 2/1992 Robbins ..... D7/590
D329,380 S * 9/1992 Hazlett ..... D9/434
D331,194 S * 11/1992 Pezzoli ..... D9/434
5,249,770 A * 10/1993 Louthan ..... A47K 1/09 248/230.8
5,358,128 A * 10/1994 Belokin ..... F25D 25/02 211/75
5,655,673 A * 8/1997 Weterrings ..... A47B 81/00 211/74
D400,384 S * 11/1998 Belokin ..... D6/574
D403,869 S * 1/1999 Harmon ..... D6/320
5,913,433 A * 6/1999 Belokin ..... A47F 3/0486 211/75
5,924,579 A * 7/1999 DuPont ..... A45D 44/02 211/60.1
D413,473 S * 9/1999 Belokin ..... D6/574
D413,474 S * 9/1999 Belokin ..... D6/574
6,082,687 A * 7/2000 Kump ..... G09F 3/204 248/224.51
6,102,215 A * 8/2000 Guida ..... B25H 3/04 211/75
D436,537 S * 1/2001 Robbins ..... D7/590
6,279,760 B1 * 8/2001 Broeski ..... A47J 47/16 211/74
6,899,236 B2 * 5/2005 Yang ..... A47B 81/00 211/75
D510,015 S * 9/2005 Hostetler ..... D8/373
7,017,759 B1 * 3/2006 Friend ..... A47B 73/00 248/312
7,028,962 B1 * 4/2006 Hostetler ..... B63C 11/02 248/205.9
D589,782 S * 4/2009 Rowell ..... D8/356
7,556,159 B2 * 7/2009 Robertson ..... A47B 96/02 211/75
D637,457 S * 5/2011 Thompson ..... D7/600.1
7,975,858 B2 * 7/2011 Schneider ..... A47F 5/0043 211/75
8,186,524 B2 * 5/2012 Siahpush ..... A47F 7/283 211/133.4
9,526,356 B2 * 12/2016 Pichel ..... A47F 5/0043
D789,114 S * 6/2017 Reed ..... D6/553
D790,249 S * 6/2017 Park ..... D6/540
D817,728 S * 5/2018 Brown ..... D7/701
10,315,321 B2 * 6/2019 Frierson ..... A45D 44/02
D855,408 S * 8/2019 Tsai ..... D7/600.1
D895,371 S * 9/2020 Brown ..... D7/554.2
10,869,563 B2 * 12/2020 Brenner ..... G09F 23/00
11,033,121 B1 * 6/2021 Gudaitis ..... A47B 77/16
D953,774 S * 6/2022 Serhii ..... D6/552
11,925,280 B2 * 3/2024 Brenner ..... G09F 7/18
2002/0158032 A1 * 10/2002 Belokin ..... A47F 5/08 211/75
2003/0160060 A1 * 8/2003 Hornblad ..... A47F 5/08 221/256
2003/0209505 A1 * 11/2003 Belokin ..... A47F 7/283 211/75
2003/0222037 A1 * 12/2003 Belokin ..... G09F 7/18 211/75
2004/0055981 A1 * 3/2004 Walsh ..... A47F 7/28 211/75
2006/0043036 A1 * 3/2006 Robertson ..... A47F 3/0486 211/75
2006/0054575 A1 * 3/2006 Robertson ..... A47F 3/0486 211/75
2006/0060549 A1 * 3/2006 Robertson ..... A47F 3/0486 211/75
2007/0152120 A1 * 7/2007 Hostetler ..... B63C 11/22 248/206.3
2010/0148025 A1 * 6/2010 Belokin ..... A47F 5/0807 248/206.2
2015/0250333 A1 * 9/2015 Schaefer ..... A47F 5/08 248/205.8
2020/0093285 A1 * 3/2020 Brenner ..... A47F 3/0486

* cited by examiner

CADDY

BACKGROUND OF THE INVENTION

Technical Field

The present invention relates to a system and method for a caddy for housing and displaying cans.

Description of Related Art

Items, such as drinks, are often packaged as a can. However, the display and branding on the can is typically hidden when the can is displayed. As such, there is a need for a system to display cans without interfering with the can branding.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
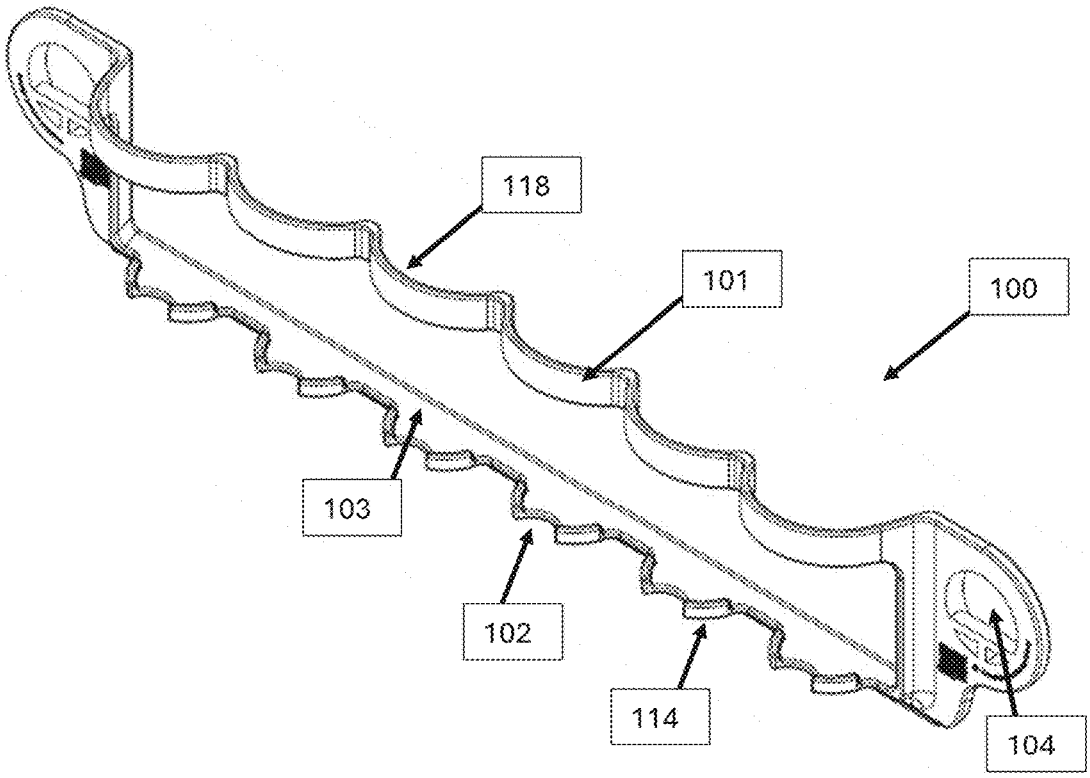
FIG. 1 is a perspective view of the caddy in one embodiment.

FIG. 1 is a perspective view of the caddy in one embodiment. A caddy, as used herein, refers to an item which is used to house, display, and hold one or more objects. In some embodiments, the caddy is used to house and display one or more cans.

The caddy 100 can comprise virtually any material. It can comprise plastic, rubber, metals, and combinations thereof. In one embodiment, and as described in more detail below, some components are flexible whereas other components are rigid. In one embodiment the material for the caddy 100 comprises polycarbonate. Polycarbonate, in some embodiments, has a flexural yield strength of 36-103 MPa. When used in the caddy 100 it is able to flex +/−35 mm from neutral without breaking.

As shown, the caddy 100 has a top brace 101 and a frame 103. The frame 103 has a plurality of bottom contours 102. A frame 103 extends for the length of the caddy 100 and provides structure. In one embodiment the frame 103 is rigid. In one embodiment the frame 103 has some flex to compensate for the weight of the cans. In one embodiment the frame 103 curves upward by 3 degrees in the center. This compensates for the weight of the inserted cans. When the cans are inserted, the frame 103 flattens to be flat.

The top brace 101, as shown, and in one embodiment, has a plurality of curves, or top contours 101, which are designed to mimic the outer diameter of the can. The caddy 100 maintains contact with the surface by use of a pressure mechanism and geometry. The caddy 100 secures the cans or bottles by use of an inward concaved top brace 101 which extends along the length of the caddy 100 between suction cup attachments. As will be shown, the top brace 101 inverts to secure the can or bottle securely between the top brace 101 and glass surface with minimal material usage. Further, as can be appreciated, if viewed by a consumer from the glass side, because the top brace 101 is on the rear side, behind the can or bottle, the branding on the can or bottle is easily viewable by the consumer with minimal or no obstruction. As will be described below, brands spend considerable time and resources designing a packaging which will entice the consumer. Covering up all or portion of the branding/label frustrates this purpose. Many such caddies exist which entirely or partially obscure the branding/label. This is undesirable and voids much of the market research which goes into designing the label. As shown, the caddy 100 allows for housing of the can/bottle with minimal or no obstruction of the package when viewed from the glass side.

As shown the top brace 101 extends the length of the caddy 100. The top brace 101 is on the top side of the caddy 100. The top brace 101 engages with the top or side portion of the can or bottle. While the description references a can, this is for illustrative purposes only and should not be deemed limiting. The caddy 100 can house and display virtually any type of containers including bottles, cans, etc.

In one embodiment, the radius edge on the top brace 101 is small to avoid can branding distortion yet smooth enough not to pierce the can when inserted or pulled out.

Figure 7:
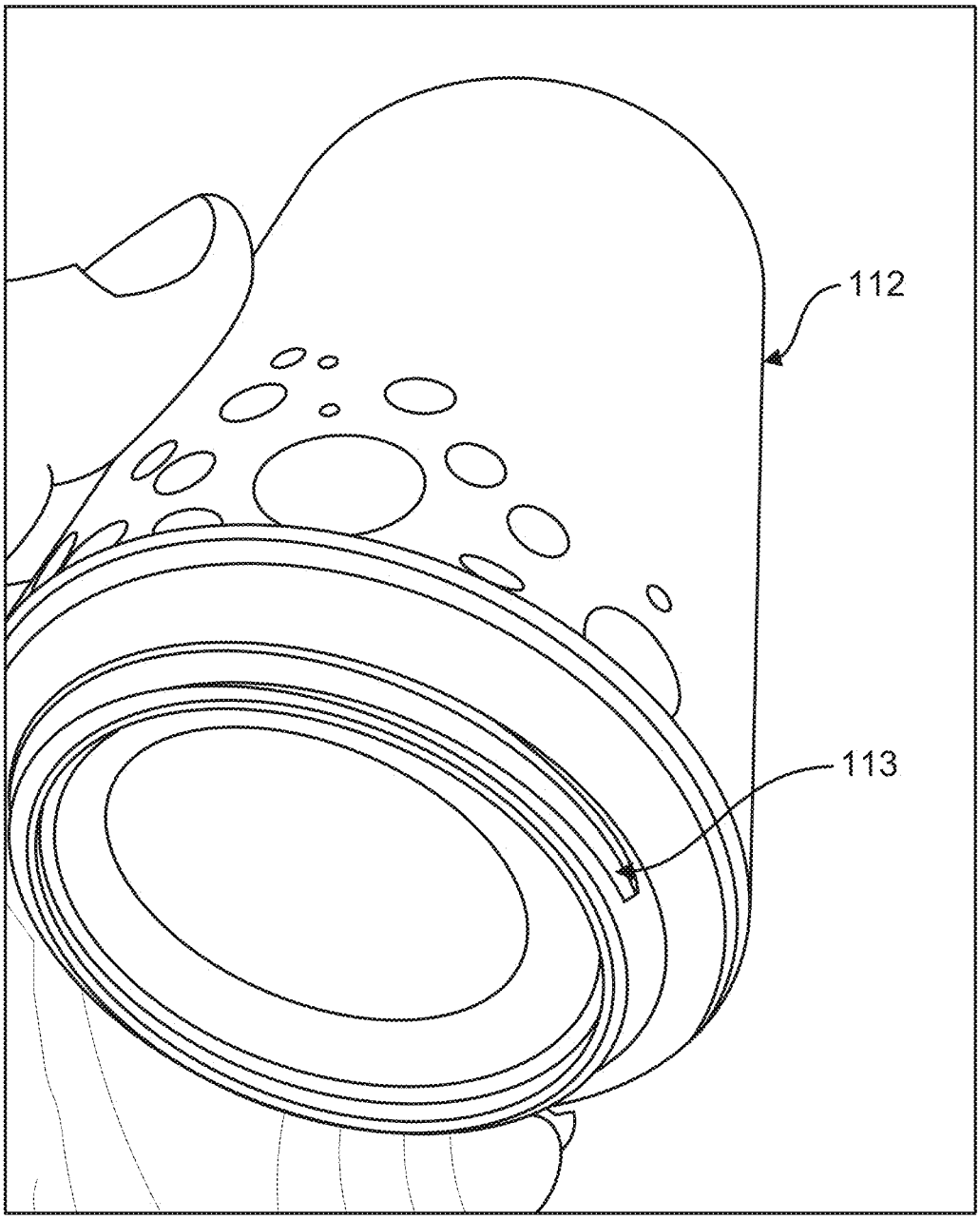
FIG. 7 is a bottom perspective of a can in one embodiment.

Turning briefly to FIG. 7, FIG. 7 is a bottom perspective of a can in one embodiment. As can be seen, the can has a can side 112 which extends upwardly from the bottom of the can to the top of the can. The can side 112 comprises an outer curvature. In one embodiment, the top brace 101 at least one top contour 118 which comprises a curvature which matches the curvature of the can side 112. Thus, if a larger can is utilized, a top contour 118 with a corresponding curvature which can accommodate the larger diameter is utilized.

As can be seen, the bottom of the can comprises a lip 113. In the embodiment depicted the lip 113 comprises an enclosed shape—in this case, an enclosed circular lip portion. When upright, the can will rest upon the lip 113. Turning back to FIG. 1, FIG. 1 shows a bottom contour 102. The bottom contour 102 engages with the bottom of the can or bottle. The bottom contour 102 can either engage outside of the lip 113 or inside the lip 113. As shown the bottom contour 102 has a smaller effective diameter than the top contour 118. In this embodiment, the top brace 101 interacts with the outside of the can whereas the bottom contour 102 acts on the inside of the lip 113. This interaction helps keep the can in its desired location.

In one embodiment, and as depicted, a portion of the bottom contour 102 raises upward to allow it to fit within the enclosed shape defined by the lip 113 of the can. Specifically, the bottom contour has a raised portion 114 which extends upward. The can will rest upon the raised portion 114. In some embodiments, the raised portion 114 sits adjacent the lip 113. This helps secure the can in its desired location. Thus, the can rests atop the bottom contour 102, and specifically, the raised portion 114. In one embodiment the raised portion 114 is raised about 3 mm above the bottom contour 102. However, in other embodiments it can be extended to about 5 mm to accommodate cans of different dimensions.

Figure 18:
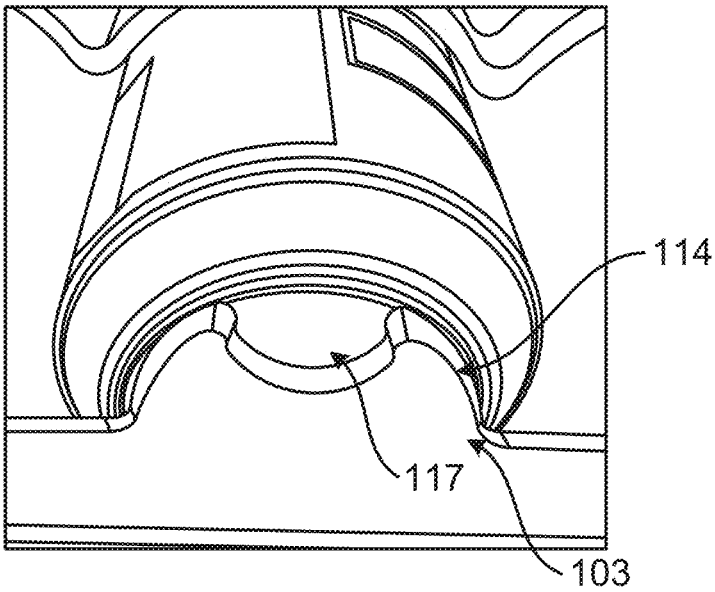
FIG. 18 is a bottom perspective view of a can sitting on a bottom contour in one embodiment.

Turning briefly to FIG. 18, FIG. 18 is a bottom perspective view of a can sitting on a bottom contour in one embodiment. As can be seen, the bottom contour 102 has a raised portion 114 which raises up and interacts with the can. The lip 113 of the can is adjacent to the raised portion 114. In one embodiment, the raised portion 114 comprises a shape which mimics the enclosed shape of the lip 113. Since the lip 113 creates a circular shape, the raised portion 114 also forms a partial circle so as to reside within, and adjacent to, the enclosed shape created by the lip 113.

As shown, the bottom contour 102 comprises a bottom contour void 117. This is a void 117 in the bottom contour 102. This provides a place for the user's finger to grip the can and lift upwards to retrieve a can. As can be seen, due the to the void, there is sufficient space for a finger to fit within which can dislodge the can from resting upon the raised portion 114.

Figure 17:
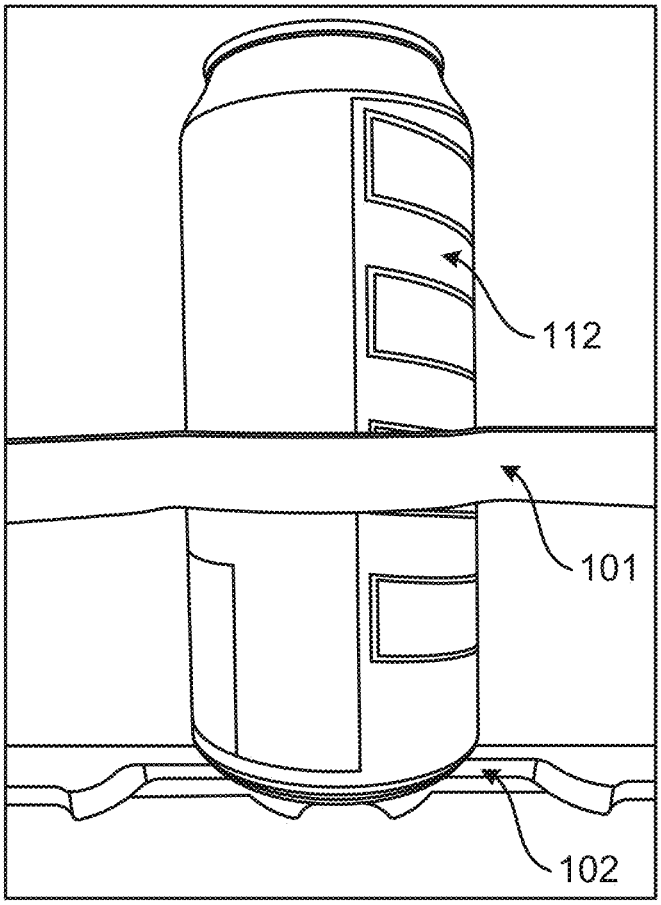
FIG. 17 is a side perspective view of a can in a caddy in one embodiment.

Turning to FIG. 17, FIG. 17 is a side perspective view of a can in a caddy. As can be seen, the top brace 101, and accordingly, the top contour 118, couples to the can side 112. As noted above, the bottom contour 112 engages with the bottom of the can.

Figure 2:
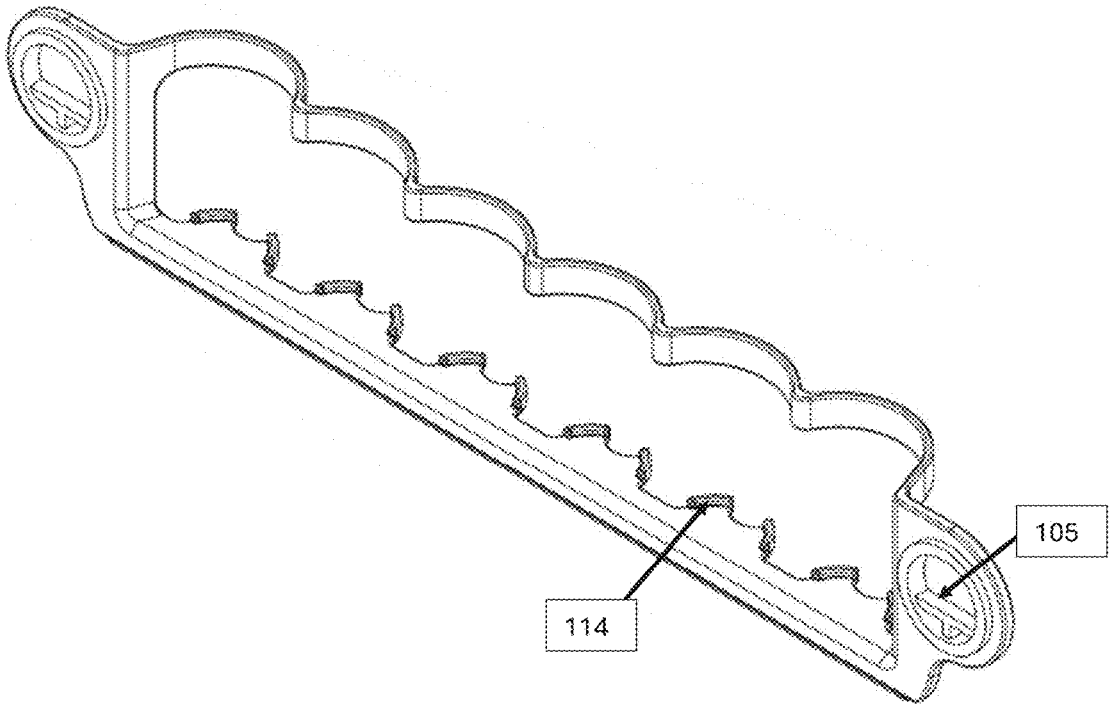
FIG. 2 is a rear perspective view of the caddy in one embodiment.

Turning to FIG. 2, FIG. 2 is a rear perspective view of the caddy in one embodiment. This is what from the side of a transparent structure that the consumer would see. This is referred to as the transparent side. The transparent structure can comprise virtually any structure which is at least partially transparent. This can include doors, windows, etc. Often the transparent structure is a transparent portion of a door or window within a refrigerator, freezer, or the like. Thus, the consumer can view the contents of the refrigerator, for example. The transparent structure can comprise virtually any material, including but not limited to, glass, plastics, etc.

As can be appreciated, if the caddy 100 is pressed up against glass, for example, such that the suction cups (not shown in this figure) are attached to the glass structure, then the consumer experiences an unobstructed view of the can/bottle. Put differently, no part of the caddy is between the can and the glass structure. Thus, no part of the caddy will obstruct the view of the packaging/label when viewed from the transparent side (what a consumer sees when looking into a closed glass door).

Figure 3:
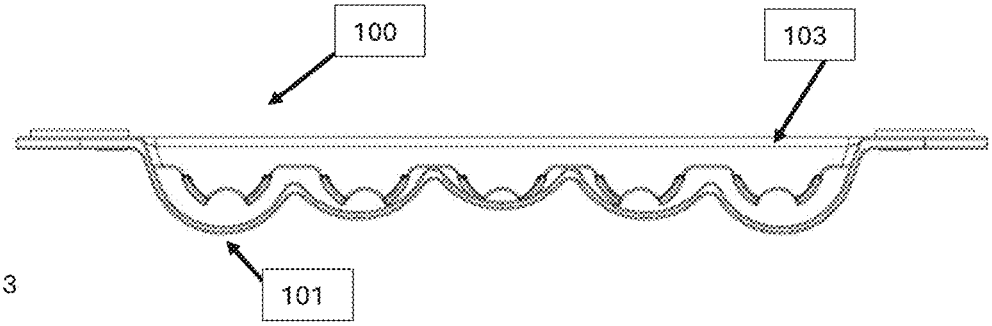
FIG. 3 is a top view of the caddy in one embodiment.

Turning to FIG. 3, FIG. 3 is a top view of the caddy 100 in one embodiment. As seen from this view, the top contour 118 often has a greater diameter than the bottom contour 102.

FIG. 3 also illustrates that in some embodiments, and as depicted, the top brace 101 has flexibility or pliability. Put differently, the top brace 101 is not rigid but is instead flexible. This flexibility applies an internal pressure against the can. In one embodiment the top brace 101 applied a force of up to 1.5 Kgs on the cans closest to the suction cups and 0.5 Kgs for the cups further from the cups. As can be seen, the top brace 101 has five distinct top contours 118. Each top contour 118 can accommodate a separate can. The first top contour 118, on the extreme left, has a greater distance from the contour to the frame 103. However, the second can contour has a decreased distance from the top contour 118 to the frame 103. This is because the top brace 101 has flex. As shown, when there are no cans, the top brace 101 is in a relaxed state. However, by applying an outward force, a new can could be inserted. The flex of the top brace 101 will now apply a force against the can. This helps assure the can stays in the desired location.

Figure 4:
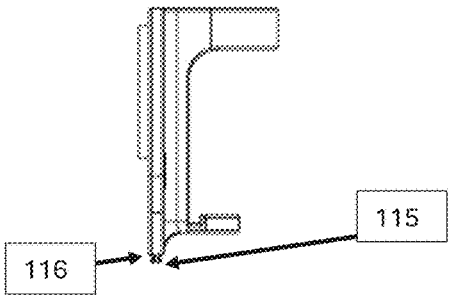
FIG. 4 is a left side view of the caddy in one embodiment.

FIG. 4 is a left side view of the caddy 100 in one embodiment. FIG. 4 also shows the relative sides of the top and bottom contours. FIG. 4 also shows a feature 115 at the bottom of the caddy 100. The feature 115, in some embodiments, is a small feature which extends outward from the bottom of the caddy 100. As shown, the feature 115 has a reduced diameter portion 116 which has a smaller diameter compared to the remaining portion of the feature 115. As will be described in more detail below, this feature 115 allows for the coupling of the display 106.

Figure 5:
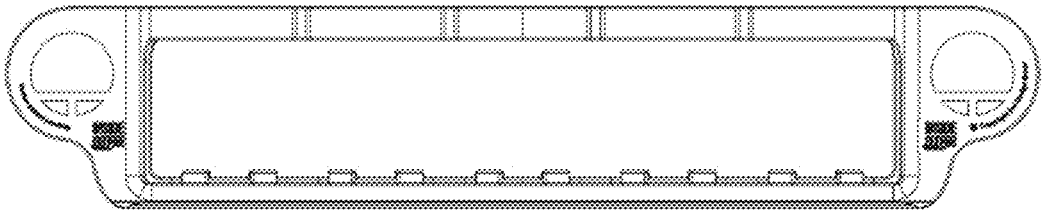
FIG. 5 is a front view of the caddy in one embodiment.

FIG. 5 is a front view of the caddy 100 in one embodiment. As can be seen, the suction cups are at either end of the caddy 100. In one embodiment the suction cup has space for marketing applications. For example, point of sale information can be displayed on the suction cups.

Figure 6:
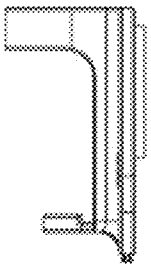
FIG. 6 is a right side view of the caddy in one embodiment.

FIG. 6 is a right-side view of the caddy in one embodiment.

Figure 8:
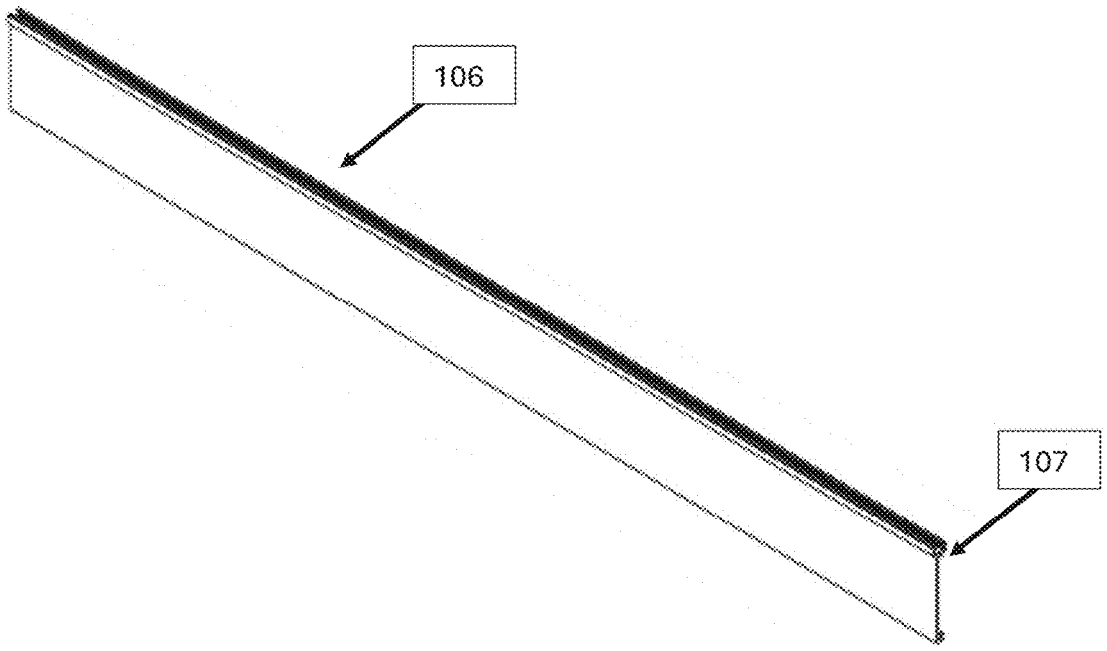
FIG. 8 is a top front perspective view of a display in one embodiment.
Figure 9:
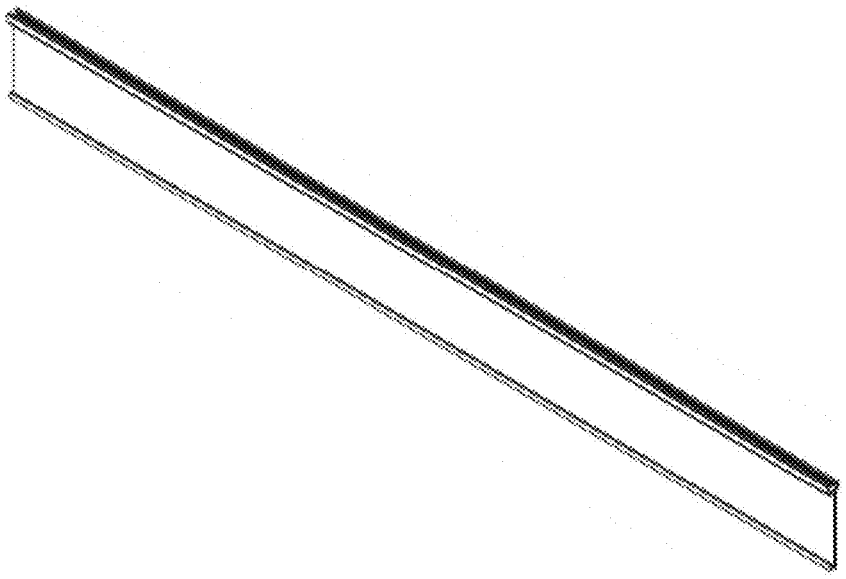
FIG. 9 is a top rear perspective view of a display in one embodiment.

Turning to FIG. 8, FIG. 8 is a top front perspective view of an optional display 106 in one embodiment. Similarly, FIG. 9 is a top rear perspective view of a display in one embodiment.

The display 106 can display any desired sales or POS information. This can include price, brand, sales information, etc. In one embodiment, the display 106 couples to the caddy 100 in such a way that the branding or label is not obstructed by the display 106. Instead, the display 106 is shown separately from the branding/label.

The display 106 can couple to the caddy 100 via any method or device known in the art. In one embodiment the display 106 comprises a coupler 107. The coupler 107 couples to a corresponding feature 115 on the caddy 100. In one embodiment the coupler 107 has a friction fit which surrounds and receives a feature 115 on the caddy 100. This allows the display 106 to couple and de-couple without any tools. Instead, the coupler 107 simply slides onto and attaches to the caddy 100.

Figure 10:
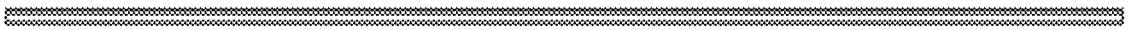
FIG. 10 is a top view of a display in one embodiment.
Figure 11:
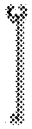
FIG. 11 is a left side view of a display in one embodiment.

Turning to FIG. 10, FIG. 10 is a top view of a display in one embodiment. FIG. 11 is a left side view of a display in one embodiment. FIG. 11 shows the open coupler 107 which can receive a feature 115 from the caddy 100. This feature allows the display 106 to be easily added or removed from the caddy 100.

Figure 12:
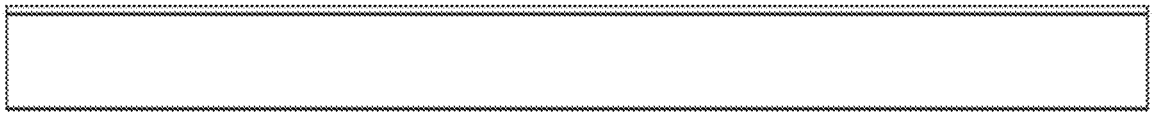
FIG. 12 is a front side view of a display in one embodiment.
Figure 13:
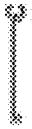
FIG. 13 is a right side view of a display in one embodiment.

FIG. 12 is a front side view of a display in one embodiment. FIG. 13 is a right-side view of a display in one embodiment.

Figure 14:
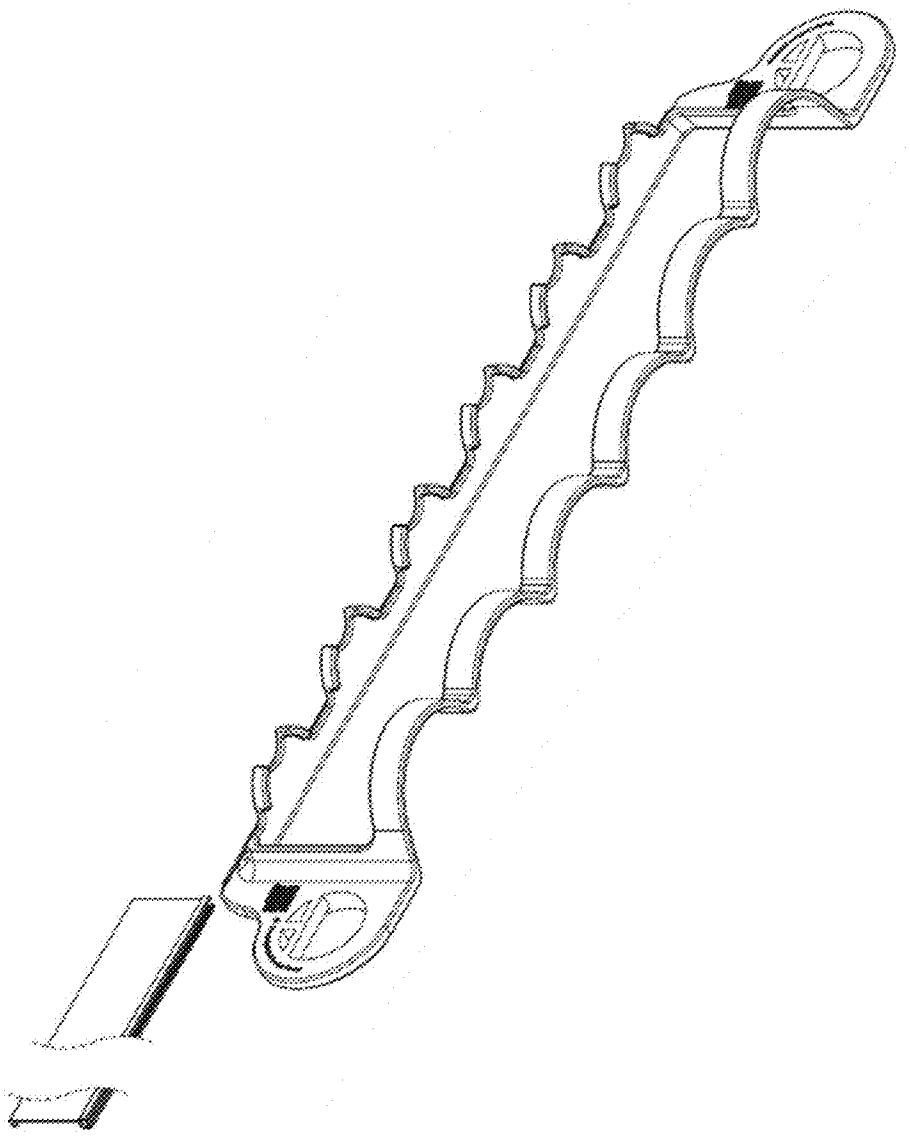
FIG. 14 is a view of a display being coupled to a caddy in one embodiment.

FIG. 14 is a view of a display 106 being coupled to a caddy 100 in one embodiment. As can be seen, the display 106 simply slides over a lower feature 115 on the caddy 100. The coupler 107 receives this feature 115. The coupler 107 rests at the reduced diameter 116 on the feature 115.

Figure 15:
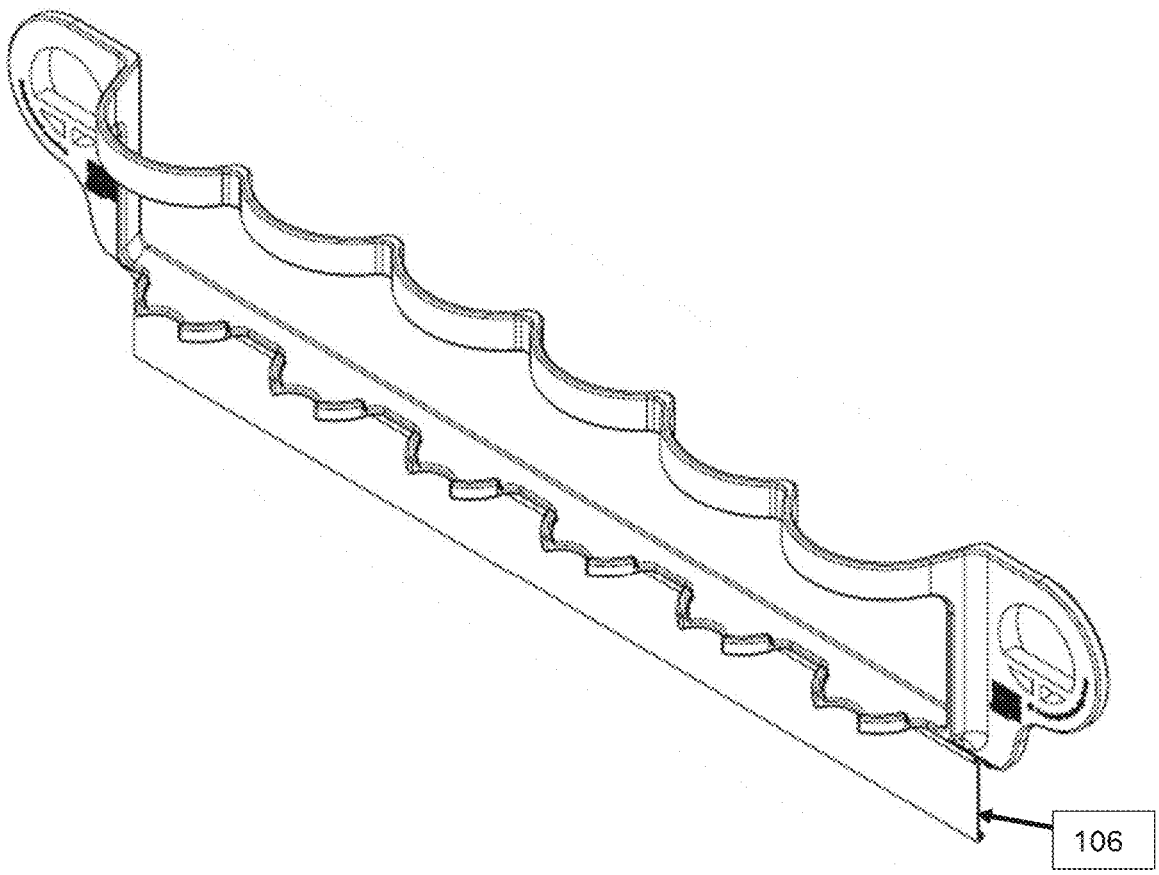
FIG. 15 is an assembled display and caddy in one embodiment.

FIG. 15 is an assembled display and caddy in one embodiment showing the display 106 coupled to the caddy 100.

Figure 16:
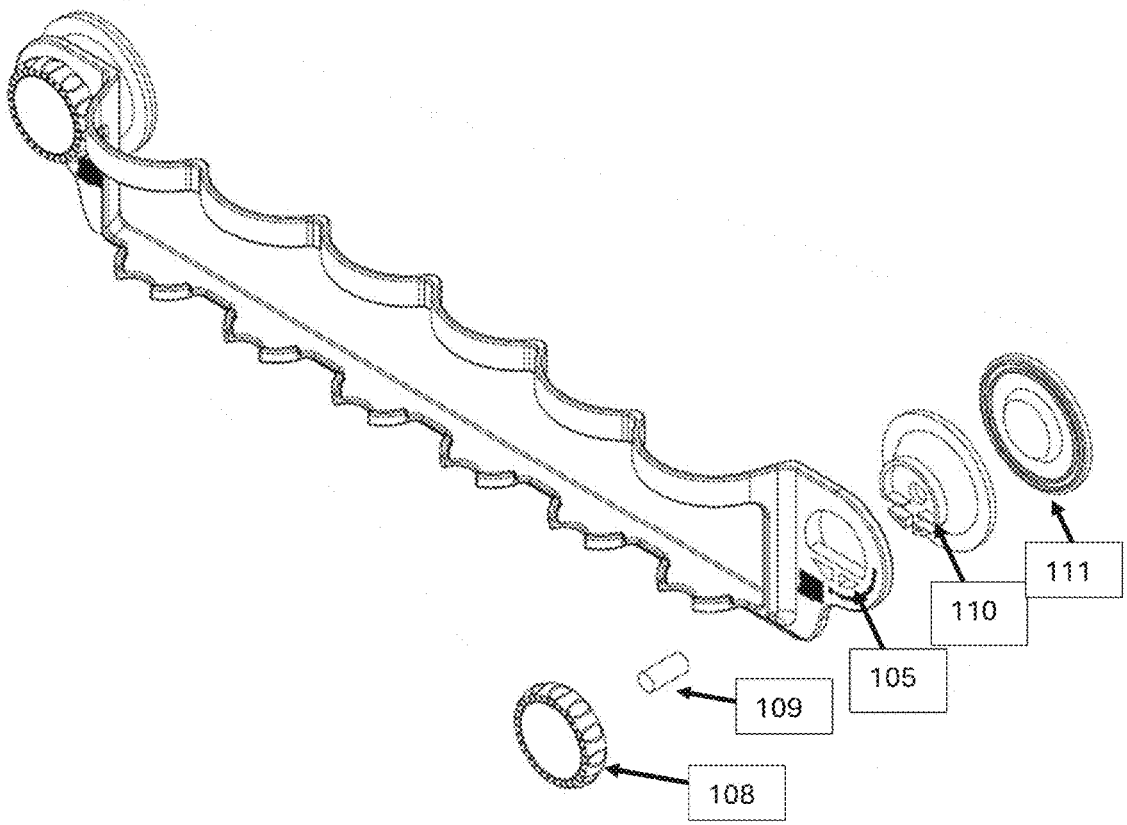
FIG. 16 is an exploded view of the suction device in one embodiment.

Turning to FIG. 16, FIG. 16 is an exploded view of the suction device in one embodiment. While one embodiment of a suction device is discussed, this is for illustrative purposes only and should not be deemed limiting. Virtually any type of suction device can be utilized.

As shown, the caddy has a void structure 105. This provides a unique structure which can be coupled to the suction structure 110. This ensures the suction is properly oriented for coupling. The suction structure 110 fits within the void structure 105. In one embodiment the two pieces are friction fitted. The system, in one embodiment, further comprises a stem 109 which is coupled to a control 108. Manipulation of the control 108, such as by rotating for example, moves the stem 109. The stem 109 likewise moves the suction cup 111. Thus, generating or releasing the suction force applied by the suction cup 111 can be controlled by the control 108.

While the caddy 100 is shown as being horizontal, this is for illustrative purposes only and should not be deemed limiting. The design can be used with vertical alignment of cans as well.

The suction shown, in one embodiment, has a weight limit of about 27 kg per suction.

The system has many advantages. First, as noted, in some embodiments, no portion of the caddy extends between the can and the transparent structure, such as glass. This means that when the user views the can from the glass side, the consumer has a completely unobstructed view. The entirety of the can or bottle labeling can be viewed by the consumer. This is ideal as the manufacturer knows what they want to present to the consumer, and a caddy which interferes with the delivery of the marketing material, is undesirable.

Additionally, this provides an unexpected aesthetic benefit. Rather than having a portion of the caddy visible, the user sees a clean view of the can presented adjacent to the transparent structure.

Another advantage is the ability to securely nest the can or bottle in the desired location. The caddy uses a flexible top brace which applies a force against the can to press the can against the transparent structure and keep it secure. The caddy also uses a bottom contour to grasp and secure the can/bottle into the desired location. The use of the flexible top brace along with the bottom contour securely and safely holds the item securely.

Another advantage is that the inverted arc presses cans, for example, against the glass with minimal contact and holds the can firm with vibration when the door is closed or opened.

Another advantage is the decreased weight to capacity achieved by the caddy. The caddy reduces raw materials usage compared to a prior caddy. In one embodiment the caddy 100 uses between about 50-70% less plastic than industry suction caddies. In one embodiment the caddy 100 uses about 68% less plastic than industry suction caddies. In previous caddies the weight was about 0.97 pounds, whereas the instant caddy is about 0.514 pounds.

Another advantage, in some embodiments, is that caddies can nest into each other to reduce space in freight meaning less air is freighted in each bod.

Another advantage is the ability to place the caddy adjacent any transparent structure. This increases visibility and flexibility. The caddy offers an additional opportunity to display containers for sale.

While the invention has been particularly shown and described with reference to a preferred embodiment, it will be understood by those skilled in the art that various changes in form and detail may be made therein without departing from the spirit and scope of the invention.

What is claimed is:

1. A caddy for holding a plurality of containers, said caddy comprising:

a single flexible top brace having a plurality of top contours along its length;

a frame coupled to said flexible top brace;

wherein said frame is further coupled to a plurality of bottom contours;

wherein each bottom contour is located below said top contours;

wherein each bottom contour comprises a raised portion which extends upward and upon which one of said plurality of containers will rest, and wherein said top contours comprise a greater diameter than said bottom contours;

suction cups on each side of said caddy, and wherein said flexible top brace extends between said suction cups.

2. The caddy of claim 1 wherein said frame is rigid.

3. The caddy of claim 1 wherein each of said bottom contours comprises a semi-circular shape.

4. The caddy of claim 1 wherein each of said bottom contours comprises a bottom contour void.

5. The caddy of claim 1 further comprising a void structure on each side of said caddy.

6. The caddy of claim 1 further comprising suction cups on each side of said caddy.

7. The caddy of claim 1 further comprising at least one can located within said flexible top brace, wherein said at least one can is supported by said bottom contours.

8. The caddy of claim 7 wherein said at least one can comprises a can lip, and wherein said can lip forms an enclosed shape, and wherein said raised portion of one of said bottom contours fits within said enclosed shape.

9. The caddy of claim 7 wherein said caddy is coupled to a transparent structure, and wherein there is no obstruction of view of the at least one can from a transparent side.

10. The caddy of claim 9 wherein no part of said caddy is between said at least one can and said transparent structure.

11. The caddy of claim 7 wherein said flexible top brace applies a force against said at least one can.

12. The caddy of claim 1 wherein said plurality of contours comprises five top contours.

13. The caddy of claim 1 wherein said caddy comprises a feature along its bottom.

14. The caddy of claim 13 wherein said feature comprises a reduced diameter portion.

15. The caddy of claim 13 further comprising a display coupled to said feature.

* * * * *